US007954809B2

(12) United States Patent
Kotani

(10) Patent No.: US 7,954,809 B2
(45) Date of Patent: Jun. 7, 2011

(54) SHEET POST-PROCESSING APPARATUS

(75) Inventor: Takashi Kotani, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 91 days.

(21) Appl. No.: 12/416,357

(22) Filed: Apr. 1, 2009

(65) Prior Publication Data

US 2009/0267290 A1 Oct. 29, 2009

(30) Foreign Application Priority Data

Apr. 25, 2008 (JP) ..... 2008-115957

(51) Int. Cl.
*B65H 31/10* (2006.01)

(52) U.S. Cl. ..... 271/217; 271/220

(58) Field of Classification Search ..... 271/213, 271/215, 217, 220
See application file for complete search history.

(56) References Cited

U.S. PATENT DOCUMENTS 6,142,469 A * 11/2000 Nanba et al. ..... 271/288
6,412,774 B1 * 7/2002 Saito et al. ..... 271/220

FOREIGN PATENT DOCUMENTS

JP 2001-226025 8/2001
JP 2003-128339 5/2003

* cited by examiner

*Primary Examiner* — Michael C McCullough
(74) *Attorney, Agent, or Firm* — Smith, Gambrell & Russell, LLP

(57) ABSTRACT

A sheet post-processing apparatus 100 includes bundle discharge rollers 6, a sheet detection sensor 31, a main tray 11, and a sheet hold device 32 having a plurality of hold portions 34*a* to 34*c*. When a sheet bundle is discharged from the bundle discharge rollers 6, the hold portions 34*a* to 34*c* rotate to a release position where the hold portions 34*a* to 34*c* stop holding the sheet bundle P stacked on the main tray 11, the main tray 11 moves downward to a wait position H2, and then, the hold portions 34*a* to 34*c* rotate to the lowest position, then the main tray 11 moves up to a hold position H1.

7 Claims, 15 Drawing Sheets

SHEET POST-PROCESSING APPARATUS

BACKGROUND OF THE INVENTION

This application is based on Japanese Patent Application No. 2008-115957 filed on Apr. 25, 2008, the contents of which are hereby incorporated by reference.

FIELD OF THE INVENTION

The present invention relates to a sheet post-processing apparatus that applies sort processing, stapling and the like to a sheet after images are formed.

DESCRIPTION OF THE PRIOR ART

For example, there is a case where binding (hereinafter, called stapling) and punching (hereinafter, called punch processing) are wanted to be applied to a bundle of comparatively large number of sheets on which images are already transferred by an image forming apparatus such as a copying machine, a printer and the like. In such a case, it is convenient to use a sheet post-processing apparatus, what is called a finisher, that carries out automatically predetermined post-processings such as stapling, punch processing and the like.

FIG. 9 is a side-sectional view showing a structural example of a conventional sheet post-processing apparatus. In FIG. 9, a sheet post-processing apparatus 100 is connected, for example, detachably to a sheet discharge side of an image forming apparatus 101 such as a copying machine and the like, and comprises a processing tray 1 that is capable of storing a plurality of sheets P. A sheet feed-in slot 2 is disposed in an right-upper portion of the processing tray 1, and a pair of feed-in rollers 3 are disposed near the sheet feed-in slot 2. When applying stapling to the sheets P after image formation, the sheets P that are successively discharged from a pair of discharge rollers 102 of the image forming apparatus go into the sheet post-processing apparatus 100 through the sheet feed-in slot 2, and are carried onto the processing tray 1 through the pair of feed-in rollers 3 and a sheet carry path 4, and stored in the processing tray 1 temporarily.

The processing tray 1 is equipped with a bundle tip-end aligning hook 9 that is movable up and down along the processing tray 1. The bundle tip-end aligning hook 9 waits at a lower end of the processing tray 1 during the time of feeding sheets in, and supports one end in the feed-in direction of each of the sheets P that are successively fed into the processing tray 1 through the pair of feed-in rollers 3. A tip-end binding stapler 5 is disposed near the wait position of the bundle tip-end aligning hook 9. The tip-end binding stapler 5 applies stapling to a bundle of the sheets P whose tip-ends in the feed-in direction are aligned by the bundle tip-end aligning hook 9. The bundle of sheets P that have undergone the stapling are carried by the bundle tip-end aligning hook 9 to an upper portion of the sheet post-processing apparatus 100 along the processing tray 1, and discharged onto an discharge tray 7 through bundle discharge rollers 6.

As such a sheet post-processing apparatus, for example, patent document 1 discloses a method in which a sheet backward-end hold members, which can carry out sheet full-stack detection and lift upper-limit position detection of a sheet discharged onto a movable sheet discharge tray, come into contact with the sheet stack surface of the tray or the sheet upper surface from a direction opposite to each other in the sheet feed-out direction, thereby stackability of sheets and accuracy of detection of trouble caused by the next discharged sheet and detection of full stack are improved.

Patent document 2 discloses a method in which a sorting discharge tray which waits with the sheet stack surface located at a reference position when the tray is empty, and moves down to allow the upper surface of a sheet bundle to come to the reference position when a sheet of the bundle is discharged, and a sheet hold member which waits until a sheet is discharged and holds the upper surface of the sheet bundle when a sheet is discharged are employed, wherein when the sheet hold member moves down beyond a tolerable range, the tray is moved up into the tolerable range, thereby poor alignment of the sheet bundle can be prevented with a relatively simple structure at low cost even when a discharged sheet is curled.

SUMMARY OF THE INVENTION

However, in the patent documents 1 and 2, because the sheet hold members hold a sheet so hard as to hit it which has been discharged and stacked on the sheet discharge tray, a hitting noise is generated at every time when the sheet hold members hold a sheet. Especially, the stronger the force to hold a sheet is, and the fewer the sheets on the tray are, the louder the generated sound becomes, and also the louder the sound that spreads from the tray to the surrounding area becomes, which cause noise generation at the time of sheet discharge.

In consideration of the conventional problems, and it is an object of the present invention to provide a sheet post-processing apparatus that is capable of preventing not only poor alignment of a bundle of sheets but also noise generation at the time of sheet discharge.

To achieve the object, a sheet post-processing apparatus according to an aspect of the present invention comprises: a discharge member for discharging a sheet; a discharge tray being movable up and down and for stacking sheets discharged from the discharge member successively thereon; a sheet detector for detecting that a sheet is discharged from the discharge member; and a sheet hold member being capable of changing its state between a hold state in which the sheet hold member holds the top surface of sheets discharged to the discharge tray and a release state in which the hold is released, wherein the discharge tray is capable of moving up and down between a hold position where the top surface of the sheets is held by the sheet hold member which is in the hold state and a wait position which is lower than the hold position and where the top surface of the sheets is not held by the sheet hold member which is in the hold state, and when the sheet detector detects sheet discharge, the sheet hold member changes its state from the release state to the hold state and the discharge tray moves down from the hold position to the wait position, then, the discharge tray moves up to the hold position, thereby the top surface of the sheets is held by the sheet hold member.

According to this structure, when a sheet is discharged, the sheet hold member changes its state from the release state to the hold state and the discharge tray moves down to the wait position, then, the discharge tray moves up to the hold position, thereby the sheet top surface of the sheets is able to be held by the sheet hold member. Thus, because it is possible to prevent the sheet hold member from hitting the sheet discharged to the discharge tray, and at the same time, to continue to hold the top surface of the sheets until the next sheet is discharged, poor alignment of the discharged sheets can be prevented, and also noise generation at the time of sheet discharge can be prevented. Besides, because the sheets are not hit, it is possible to prevent the sheets from being damaged.

The sheet post-processing apparatus having the above structure according to the aspect of the present invention further comprises a position detector for detecting that the discharge tray moves up and reaches the hold position, and the upward movement of the discharge tray is stopped based on a detection result of the position detector.

According to this structure, the position detector for detecting that the discharge tray moves up to the hold position is employed, and the upward movement of the discharge tray is stopped based on a detection result from the position detector, thereby the discharge tray can be surely moved up to the hold position. Thus, it is possible to prevent more surely poor alignment of the sheets.

In the sheet post-processing apparatus having the above structure according to the aspect of the present invention, the position detector detects states of the sheet hold member.

According to this structure, the position detector detects the states of the sheet hold member, thereby it is possible to surely push up the discharge tray to the hold position and to confirm that the sheet hold member holds the sheets. Thus, it is possible to prevent more surely poor alignment of the sheets. Besides, because the state of the sheet hold member is detected, addition of members can be avoided, and it is possible to prevent the apparatus from becoming large and complicated, which achieves low cost.

In the sheet post-processing apparatus having the above structure, the hold position of the discharge tray includes a first hold position at which sheets are able to be stacked successively and a second hold position which is positioned between the first hold position and the wait position, the sheet hold member is capable of changing its state between a first hold state in which the sheet hold member holds the top surface of the sheets at the first hold position and a second hold state in which the sheet hold member holds the top surface of the sheets at the second hold position, and when the discharge tray moves up from the wait position to the first hold position, the discharge tray pushes up the sheet hold member from the lower side of the sheet hold member being in the second hold state, thereby the sheet hold member changes its state from the second hold state to the first hold state.

According to this structure, it is possible to more surely prevent the sheet hold member from hitting the sheets discharged to the discharge tray, and at the same time, to continue to hold the top surface of the sheets until the next sheet is discharged.

In the sheet post-processing apparatus having the above structure according to the aspect of the present invention, the sheet hold member includes a rotation shaft that is rotatably supported, a hold portion protruding from the rotation shaft, and an attraction-type solenoid that has a plunger connected to the rotation shaft, wherein together with the rotation shaft, the hold portion changes its state from the hold state to the release state when the solenoid is enabled, and changes its state from the release state to the hold state when the solenoid is disenabled.

According to this structure, the sheet hold member is composed of the rotation shaft, the hold portion and the attraction-type solenoid, wherein the hold portion rotates together with the rotation shaft to change its state from the hold state to the release state when the solenoid is enabled, and rotates to change its state from the release state to the hold state when the solenoid is disenabled, thereby it is possible to quickly rotate the hold portion.

In the sheet post-processing apparatus having the above structure according to the aspect of the present invention, a plurality of the hold portions are arranged at predetermined intervals on the rotation shaft that is disposed along a sheet-width direction.

According to this structure, the hold portion is able to continue to stably hold the top surface of the sheet discharged to the discharge tray until the next sheet is carried.

In the sheet post-processing apparatus having the above structure according to the present invention, the rotation shaft and the plunger are connected to each other via a spring member.

According to this structure, because the rotation shaft and the plunger are connected to each other via the spring member, the hold member is able to hold the sheet top surface of the sheets sufficiently tightly with the aid of elastic force of the spring member.

DESCRIPTION OF THE PREFERRED EMBODIMENTS

Figure 1:
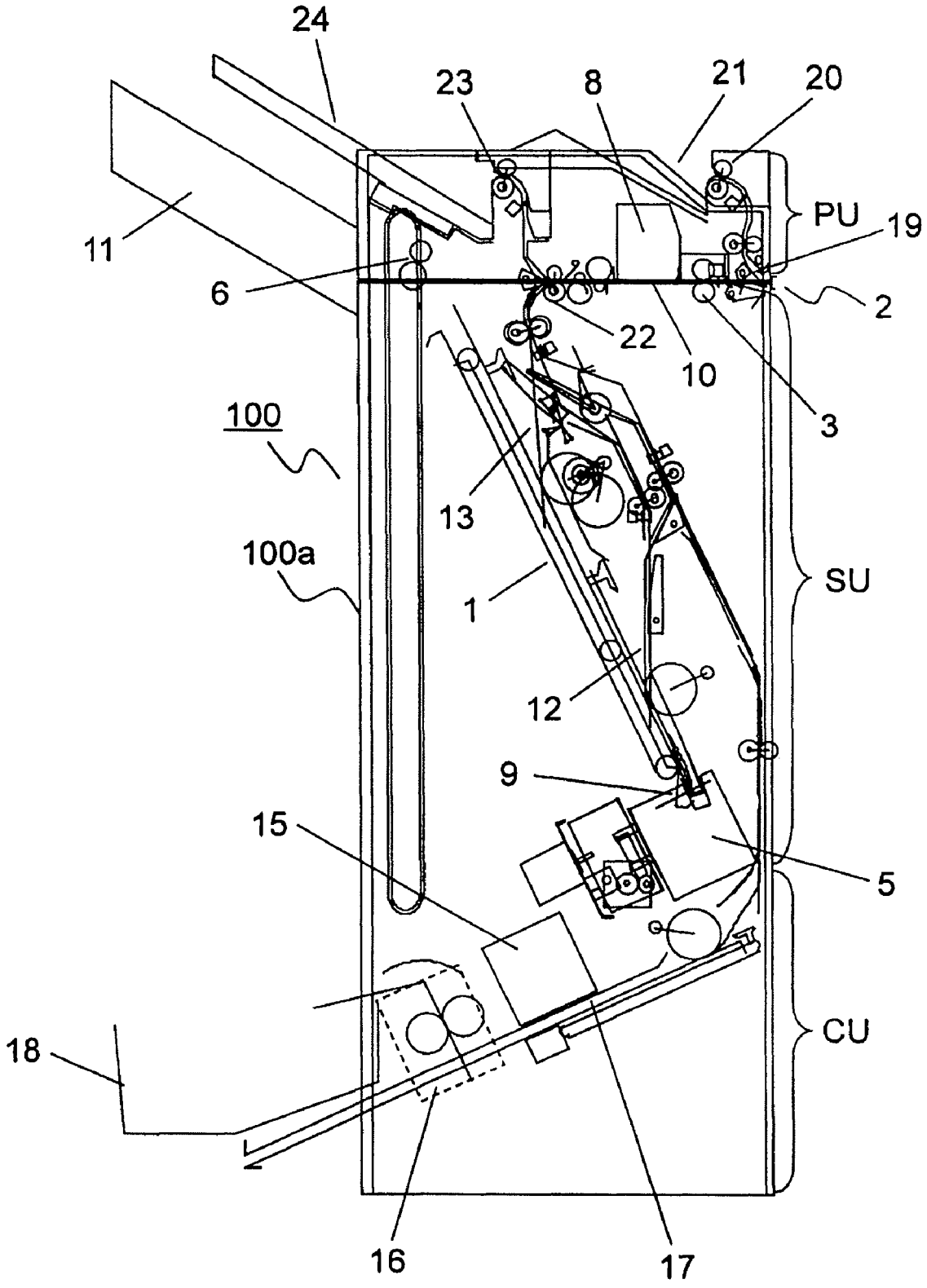
FIG. 1 is a side-sectional view showing an overall structure of a sheet post-processing apparatus according to one embodiment of the present invention.
Figure 9:
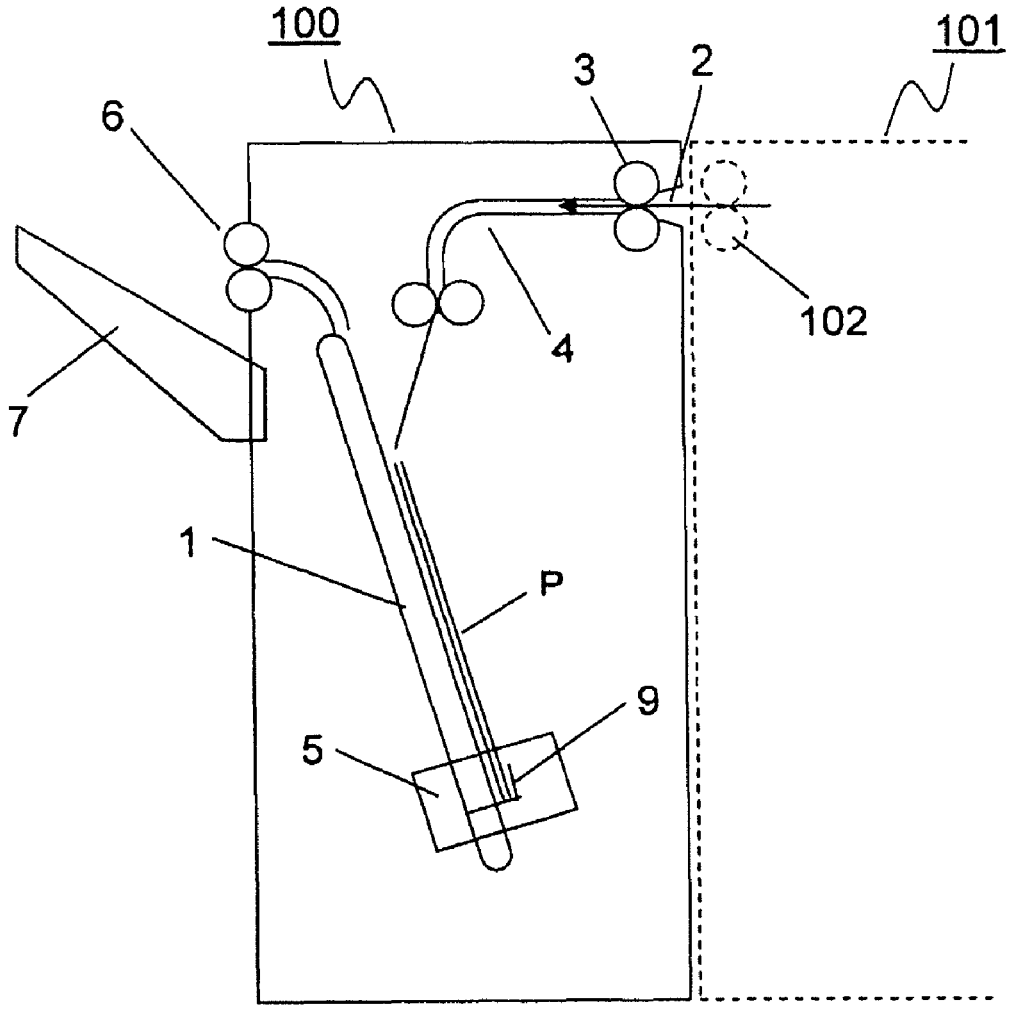
Fig. 9 PRIOR ART
FIG. 9 is a side sectional view showing an overall structure of a conventional sheet post-processing apparatus.

Hereinafter, an embodiment of the present invention is explained with reference to drawings. FIG. 1 is a side sectional view showing a structure of a sheet post-processing apparatus according to one embodiment of the present invention. The common parts as those in FIG. 9 showing a conventional apparatus are indicated by the common numbers, and explanation of them is skipped. In FIG. 1, a sheet post-processing apparatus 100 comprises a punch unit PU that punches a hole in a sheet, a tip-end binding unit SU that aligns the tip ends of a sheet bundle (sheets) stacked on a processing tray 1 and applies stapling to the sheet bundle, and a center binding and folding unit CU that folds a sheet bundle into the shape of a booklet with the stapled portion as the center line after stapling is applied to the center of the sheet bundle. The punch unit PU and the center binding and folding unit CU are detachably arranged in the sheet post-processing apparatus 100 as optional units.

The punch unit PU is disposed on an upper portion of the sheet post-processing apparatus 100, and is composed of a punched-hole forming device 8, a first discharge roller 20, and a second discharge roller 23 and the like. A sheet on which an image is formed by an image forming apparatus (not shown) is fed through a sheet feed-in slot 2 disposed in a right upper portion of the sheet post-processing apparatus 100 and through a pair of feed-in rollers 3. When neither of punched-hole forming processing and stapling is carried out, a sheet moves upward in a first branch portion 19, is discharged from the first discharge roller 20 to the outside of the apparatus, and stacked on a first sub-tray 21 disposed on an upper surface of the apparatus.

When at least one of punched-hole forming processing and stapling is carried out, a sheet moves in the left direction in a sheet feeding path 10 and passes the punched-hole forming device 8. Here, when a command to form a punched hole is given, a hole is formed though a predetermined position of the sheet after registration correction is performed by the pair of feed-in rollers 3. When a command to form a punched hole is not given, the sheet passes the punched-hole forming device 8 without a hole being formed, and is carried to a second branch portion 22.

When stapling is not performed, the sheet moves upward through the second branch portion 22, is discharged to the outside of the apparatus by the second discharge roller 23, and stacked on a second sub-tray 24. When a mail box (not shown) is disposed as an optional unit above the second sub-tray 24, it is possible to sort the sheets for many purposes such as sorting for a plurality of users, for different sheet sizes and the like.

On the other hand, when stapling is performed, the sheet moves downward through the second branch portion 22, and is carried to the tip-end binding unit SU or to the center binding and folding unit CU described later. The tip-end binding unit SU disposed under the punch unit PU is composed of the processing tray 1, a first feed portion 12 that feeds sheets to the processing tray 1, a second feed portion 13, and a tip-end binding stapler 5 and the like. A sheet not larger than a predetermined size (here, A-four size) is stacked on the processing tray 1 by the first feed portion 12, and a sheet larger than a predetermined size is stacked on the processing tray 1 by the second feed portion 13.

A bundle of sheets stacked on the processing tray 1 are aligned by a bundle tip-end aligning hook 9, carried to the tip-end binding stapler 5 to be bound at the tip end, moved again upward along the processing tray 1, carried through bundle discharge rollers (an discharge member) 6, and discharged on a main tray (a discharge tray) 11 protruding from a left-cover 100*a* to the outside.

The center binding and folding unit CU disposed under the tip-end binding unit SU is composed of a center binding stapler 15, a center folding device 16, a sheet guide 17 and the like. The center binding stapler 15 applies stapling to the center of a sheet bundle stacked in the sheet guide 17. The sheet bundle that has undergone the stapling applied by the center binding stapler 15 is folded by the center folding device 16 into the shape of a booklet with respect to the stapled (bound) portion used as the center, and then discharged in a brochure tray 18.

Figure 2:
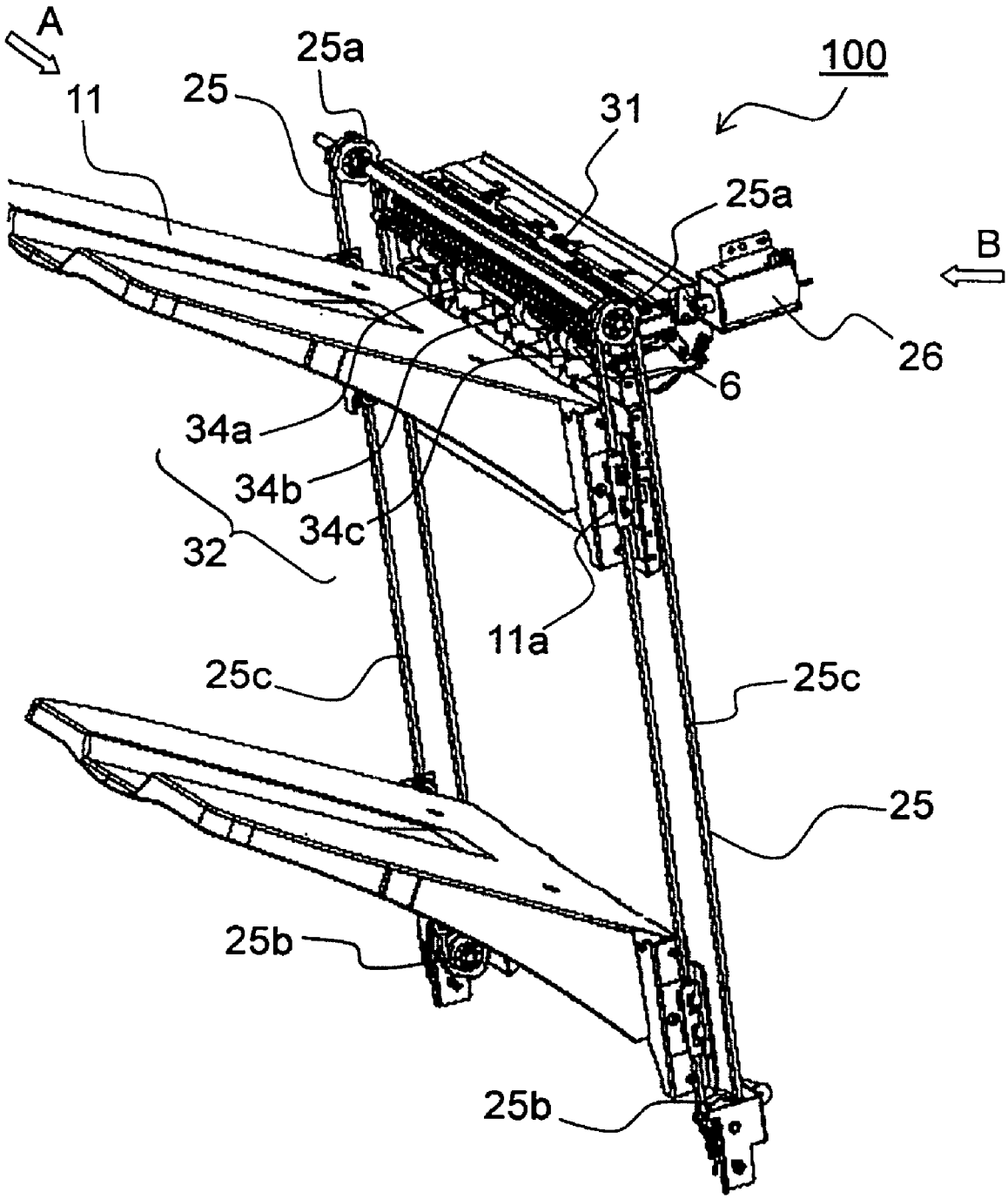
FIG. 2 is a partial perspective view showing innards on a left-cover side of a sheet post-processing apparatus according to the embodiment of the present invention.

Next, a structure of the main tray and related portions of the sheet post-processing apparatus according to the present invention is explained. FIG. 2 is a partial perspective view showing a structure of the left-cover side inside the sheet post-processing apparatus according to the embodiment of the present invention. In FIG. 2, the main body of the sheet post-processing apparatus is not shown for explanation convenience, and the left cover 100*a* is shown in a separate state from the main body.

As shown in FIG. 2, a sheet detection sensor (a sheet detector) 31 is disposed in a feed path (not shown) nearest to the upstream side in the sheet-feed direction of the bundle discharge rollers 6. A sheet that has passed the sheet detection sensor 31 is discharged from the bundle discharge rollers 6 at a predetermined timing and stacked on the main tray 11. An discharge solenoid 26, which adjusts the feed path and the roller gap of the bundle discharge rollers 6 according to the thickness of a sheet bundle when discharging the sheet bundle that has undergone stapling, is connected to the bundle discharge rollers 6 through a connecting member, not shown.

As the sheet detection sensor 31, generally, an optical sensor that includes a light emitting device having an LED and the like, and a light receiving device having a photodiode and the like is used. Light emitted from the light emitting device enters the light receiving device as reflected light from a sheet when the sheet is passing under the sheet detection sensor 31, and as reflected light from the lower surface of the feed path after the sheet passes through the sheet detection sensor 31. Using difference in the reflected light, it is possible to detect that the sheet passes through the sheet detection sensor 31, thereby it is possible to detect that the sheet is discharged from the bundle discharge rollers 6.

As shown in FIG. 2, two tray lift devices 25 are disposed in a vertical direction along the left cover 100*a* (see FIG. 1) for the main body of the apparatus. The tray lift device 25 is composed of a driving pulley 25*a*, a driven pulley 25*b*, a tray lift belt mounted on the driving pulley 25*a* and the driven pulley 25*b*, and a driving motor (not shown) that rotates the driving pulley 25*a*.

The main tray 11 is fixed to the tray lift belt 25*c* disposed on the tray side (the left side in FIG. 2) with a fixing member 11*a*, and moves up and down as the tray lift belts 25*c* rotate when the driving motor rotates the driving pulleys 25*a* forward and backward. In FIG. 2, one state in which the main tray 11 is moved to the lowest position and the other state in which the main tray 11 is moved to the highest position are shown.

As described later, the main tray 11 is so designed as to move up and down between a hold position H1 (see FIGS. 7A, 7B) where the top surface of a sheet bundle P discharged on the tray is held by hold portions (sheet hold members) 34*a* to 34*c*, and a wait position H2 which is lower than the hold position H1 and where the hold portions 34*a* to 34*c* do not hold the top surface of the sheet bundle discharged on the tray even when the hold portions 34*a* to 34*c* rotate to the lowest position.

Figure 3A:
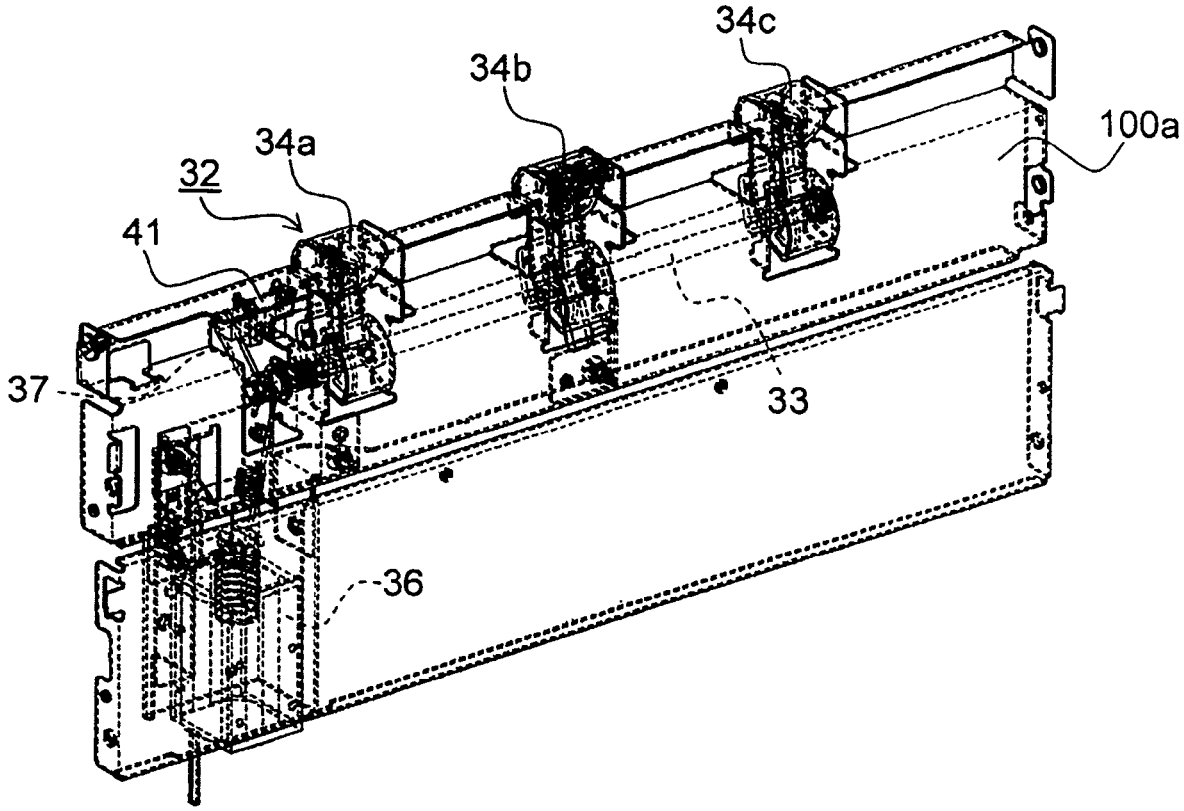
FIG. 3A is a view showing a structure of a sheet hold device and related portions, that is, a partial perspective view seen from an A direction (from the outside to the inside of the apparatus) in FIG. 2.
Figure 3B:
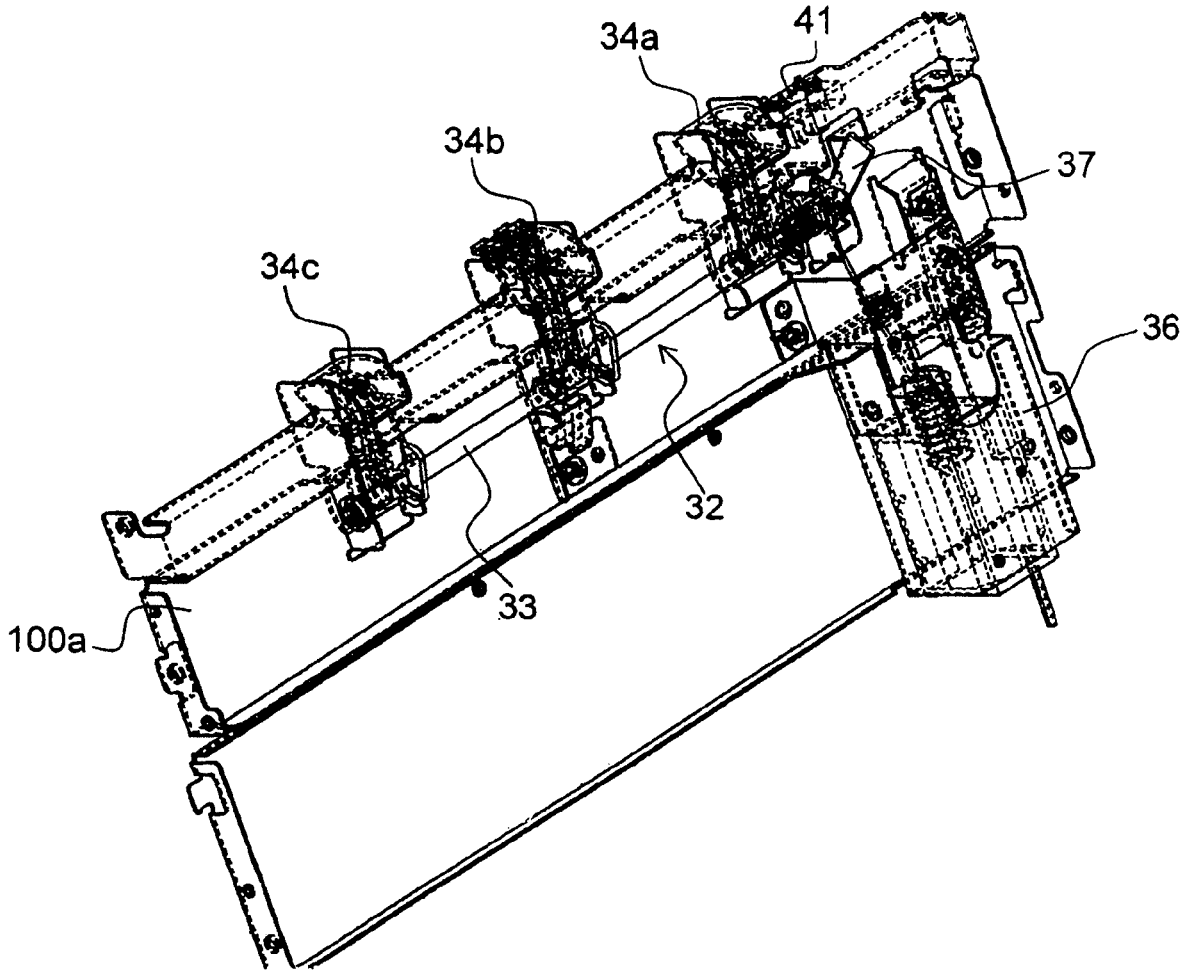
FIG. 3B is a view showing a structure of a sheet hold device and related portions, that is, a partial perspective view seen from a B direction (from the inside to the outside of the apparatus) in FIG. 2.
Figure 4A:
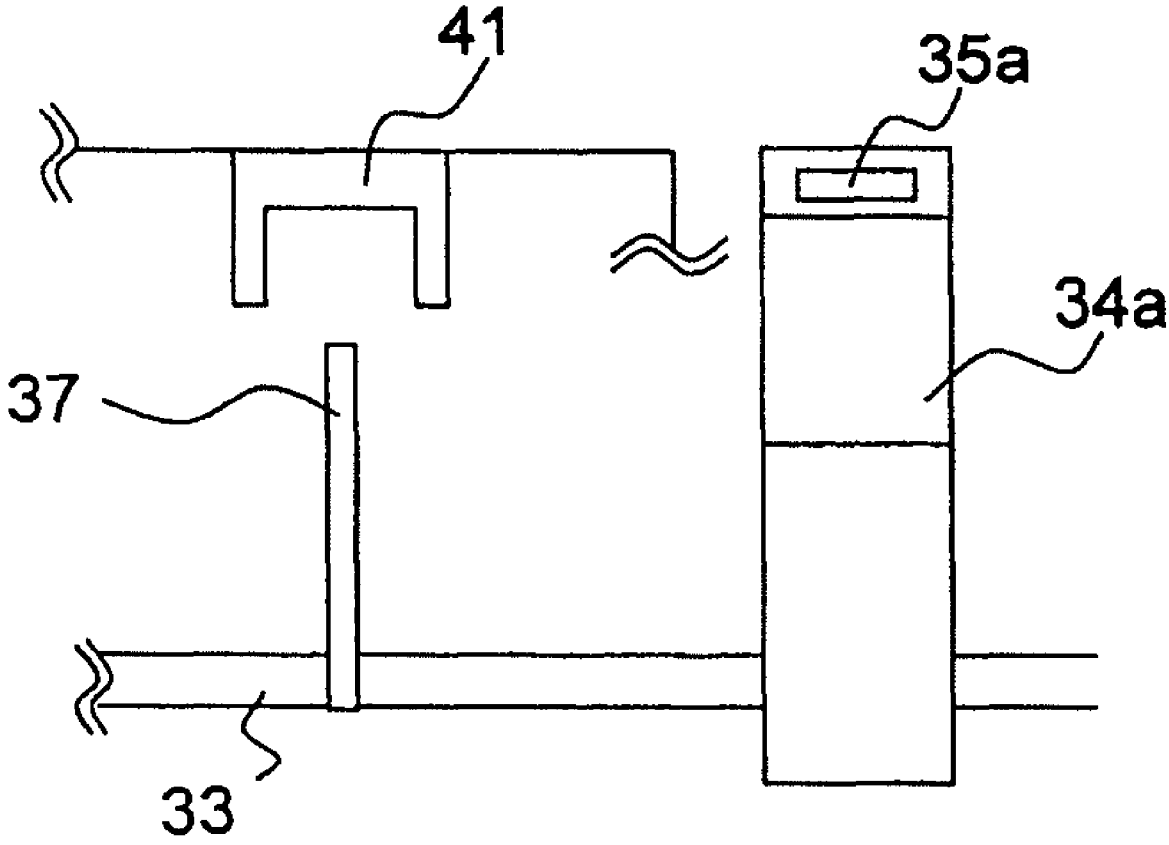
FIG. 4A is a view showing a structure of a hold portion and nearby portions, that is, a plan view seen from the outside of a sheet post-processing apparatus according to the embodiment of the present invention.
Figure 4B:
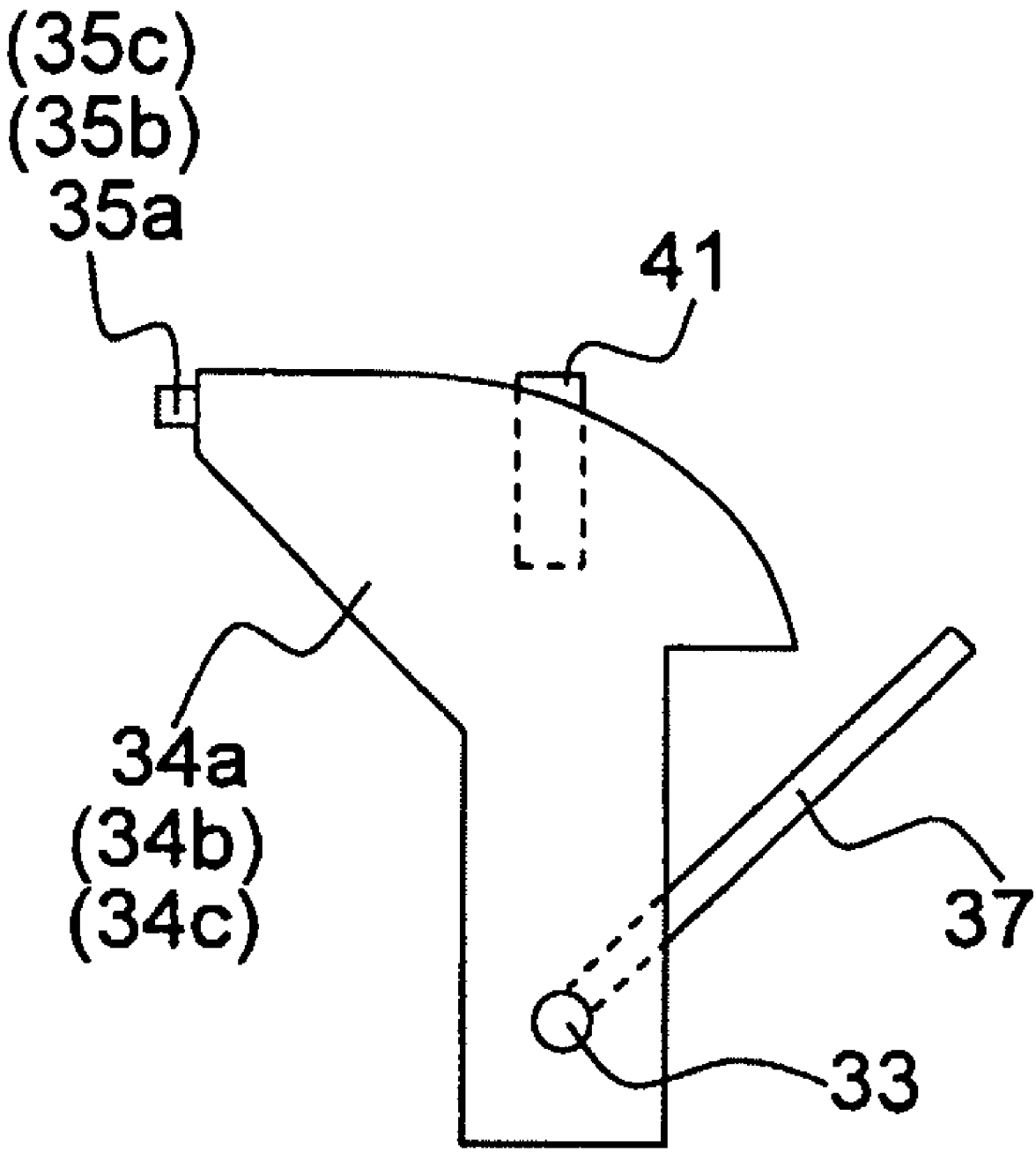
FIG. 4B is a view showing a structure of a hold portion and nearby portions, that is, a side view seen from the right side in FIG. 4A.
Figure 5:
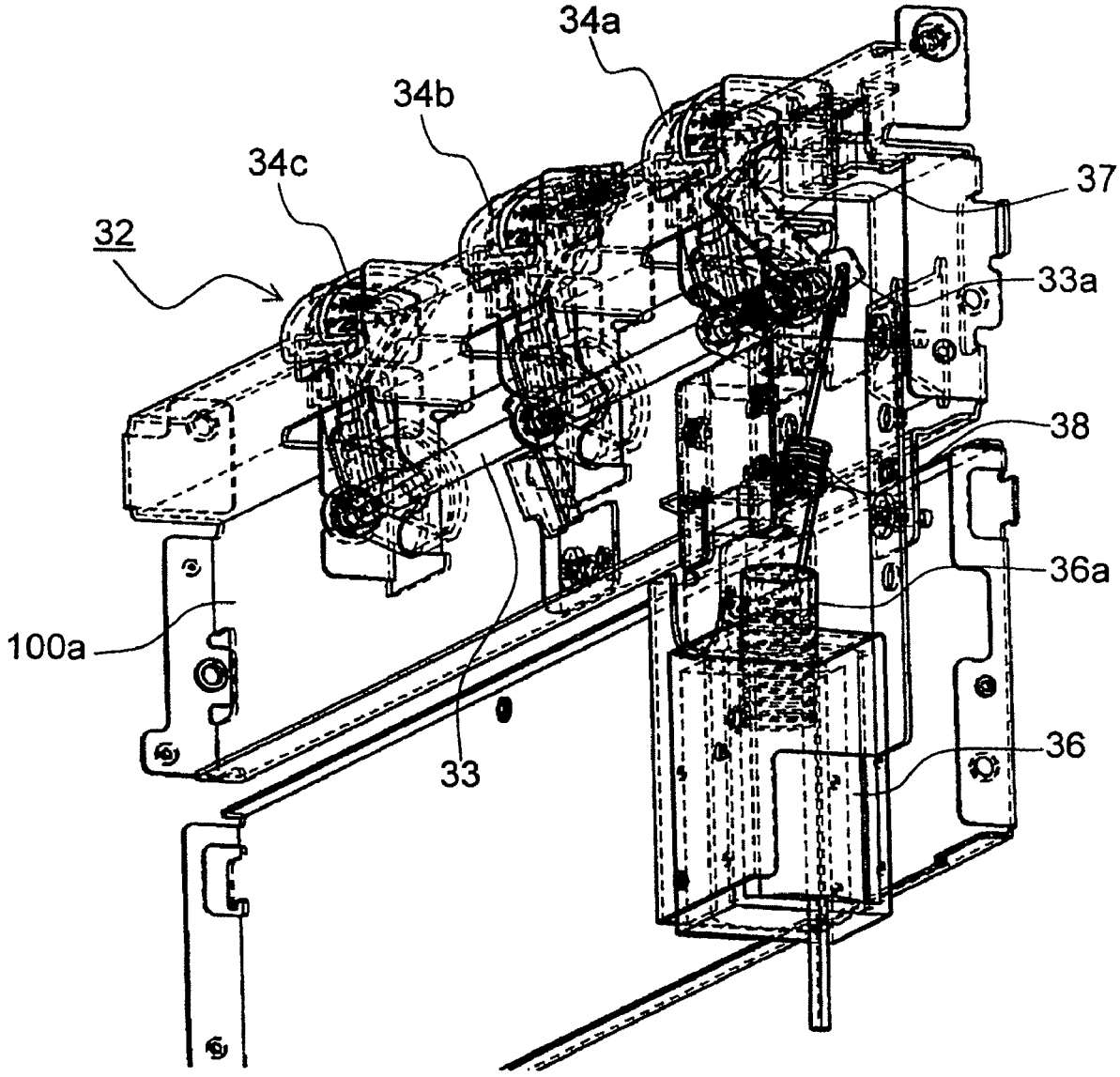
FIG. 5 is a view showing a structure of a shaft, a hold solenoid and other related portions, that is, a perspective view seen from the inside of a sheet post-processing apparatus according to the embodiment of the present invention.

Besides, as shown in FIG. 2, a sheet hold device (a sheet hold member) 32 is disposed right under the bundle discharge rollers 6. FIG. 3A is a partial perspective view seen from the A direction (from the outside to the inside of the apparatus) in FIG. 2 and shows a structure of the sheet hold device and related portions. FIG. 3B is a partial perspective view seen from the B direction (from the inside to the outside of the apparatus). FIG. 4A is a plan view seen from the outside of the apparatus and shows a hold portion and nearby portions, and FIG. 4B is a side view seen from the right side in FIG. 4A. FIG. 5 is a perspective view seen from the inside of the apparatus and shows a structure of a shaft, a hold solenoid and other related portions. Because the hold portions 34*a* to 34*c* have the common structure, only the hold portion 34*a* is shown in FIG. 4. The common parts as those in FIG. 2 are indicated by the common numbers, and explanation of them is skipped.

As shown in FIGS. 3 and 4, the sheet hold device 32 is equipped with a shaft 33, the hold portions 34*a* to 34*c*, a flag 37, and a hold solenoid 36. The shaft 33 is rotatably supported by the main body of the apparatus, and the three hold portions 34*a* to 34*c* are so disposed at predetermined intervals in the shaft direction as to protrude from the shaft 33. The tip-ends of the hold portions 34*a* to 34*c* protrude into a substantially L shape toward the outside (the right lower side in FIG. 3A, the left side in FIG. 4B) of the main body of the apparatus. Butting portions 35*a*, 35*b* and 35*c* that are formed of an elastic material having a relatively large friction coefficient are disposed on the tip-ends of the hold portions 34*a*, 34*b* and 34*c*, respectively. The hold portions 34*a* to 34*c* hold a sheet on the main tray 11 through the butting portions 35*a* to 35*c*.

As shown in FIG. 5, a protrusion portion 33*a* is formed on one end of the shaft 33 near the rear side (the right side in FIG. 5) of the main body of the apparatus. One end of a spring member 38 having a coil spring at the center portion thereof is connected to the protrusion portion 33*a*, and the other end of the spring member 38 is connected to a plunger 36*a* of an attraction-type hold solenoid 36. In FIG. 5, a state where the hold solenoid 36 is in a stop state is shown, in which when the hold solenoid 36 is disenabled, the plunger 36*a* is released to come out from the solenoid 36, and the shaft 33 rotates counterclockwise with the aid of elastic force of the spring member 38.

When the shaft 33 rotates, the hold portions 34*a* to 34*c* rotate downward (state change). When the main tray 11 is held at the wait position H2 (see FIG. 7C) described later, the hold portions 34*a* to 34*c* do not butt the main tray 11 and the sheet bundle P placed on the tray 11, and the hold portions 34*a* to 34*c* rotate to the lowest position (hold state, a second hold state) where the load by the spring member 38 becomes substantially 0 (normal state).

On the other hand, when the hold solenoid 36 is enabled, the plunger 36*a* is attracted and counters elastic force of the spring member 38 to pull the protrusion portion 33*a*, thereby the shaft 33 rotates clockwise. Thus, the hold portions 34*a* to 34*c* rotate to a release position where the hold against the sheet is released (release state). At the release position, the hold portions 34*a* to 34*c* stand substantially upright.

In the time the main tray 11 is held at the hold positions H1 (see FIGS. 7A, 7E) described later, when the hold portions 34*a* to 34*c* rotate downward, the hold portions 34*a* to 34*c* butt the main tray 11 at a hold position (hold state, a first hold state) between the lowest position and the release position, and hold the main tray 11 with a predetermined hold force with the aid of elastic force of the spring member 38. When the sheet bundle P is stacked on the tray, the hold portions 34*a* to 34*c* hold the sheet bundle P with the predetermined hold force.

As shown in FIGS. 3 and 4, between the hold portion 34*a* and the protrusion portion 33*a* on the shaft 33, the flag 37 protruding at an angle smaller than those of the hold portions 34*a* to 34*c* to the shaft is disposed (see FIG. 4B). The flag 37 rotates together with the shaft 33 when the shaft 33 rotates.

Right over the position of the flag 37 on the shaft 33, a hold-position detection sensor (position detector) 41 which protrudes downward into C-shaped protrusion portions is disposed, and the tip end of the flag 37 passes through the gap between the C-shaped protrusion portions without hitting the hold-position detection sensor 41. The hold-position detection sensor 41 detects rotation positions of the hold portions 34*a* to 34*c* and a lifted position of the main tray 11.

The light emitting device and light receiving device described above are so disposed on the C-shaped protrusion portions of the hold-position detection sensor 41 as to be opposite to each other, so that light emitted form the light emitting device enters the light receiving device. When the flag 37 is passing through the hold-position detection sensor 41, the flag 37 blocks light emitted from the light emitting device, and an amount of light that enters the light receiving device decreases. Thus, the flag 37 is detected. The flag 37 and the hold-position detection sensor 41 are so disposed that the flag 37 comes to a position between the protrusion portions of the hold-position detection sensor 41 when the hold portions 34*a* to 34*c* rotate to the hold positions as the shaft 33 rotates.

Thus, it is possible to detect that the hold portions 34*a* to 34*c* rotate to the hold positions to hold the top surface of the sheet bundle P discharged on the main tray 11. At the same time, it is possible to detect that the top surface of the sheet bundle P on the main tray 11 has moved up to the hold position H1 (see FIG. 7) described later. Thus, it is possible to allow the top surface of the sheet bundle P to come to a substantially constant position according to a stack amount of the sheet bundle P.

In addition, the sheet post-processing apparatus 100 is equipped with a wait-position detection sensor, not shown, to detect that the top surface of the sheet bundle P on the main tray 11 reaches the wait position H2 described later. As the wait-position detection sensor, an optical sensor like the optical sensor described above can be used. It is possible to so design the main tray 11 that the main tray 11 comes to a position lower than the wait position H2 during the time the apparatus is in the stop state, and moves up and down between the hold position H1 and the wait position H2 during the time the apparatus is in the operation state.

Figure 6:
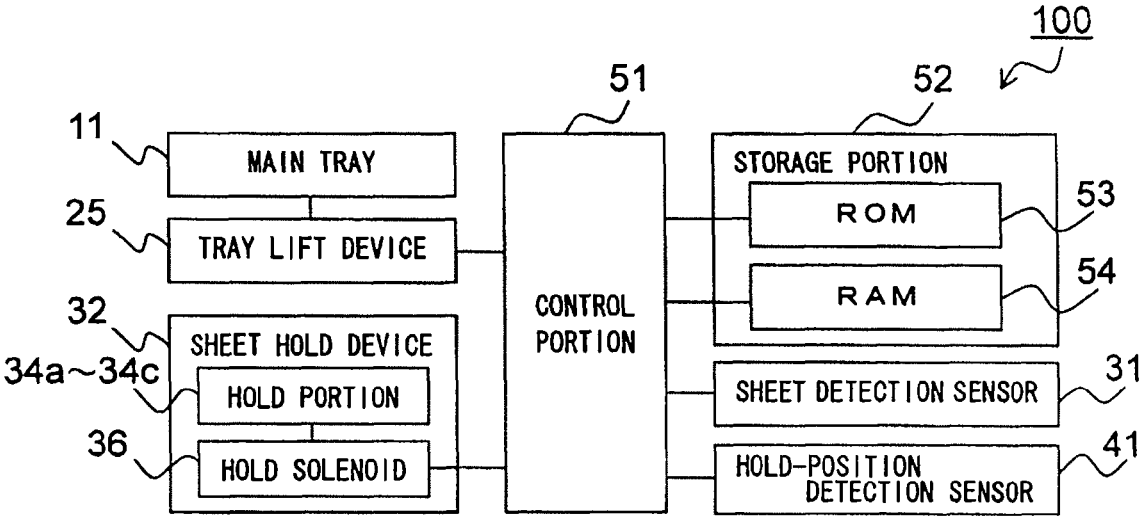
FIG. 6 is a block diagram showing a control circuit for sheet-hold operation of a sheet post-processing apparatus according to the one embodiment of present invention.

FIG. 6 is a block diagram showing a control circuit for the sheet hold operation of the sheet post-processing apparatus according to the embodiment of the present invention. The sheet post-processing apparatus 100 has a control portion 51 including a central processing unit (CPU) that executes operations following a control program and the like, a storage portion 52 that includes a ROM 53 for storing the control program and a readable and writable RAM 54 for storing operation results and the like, and others which are not shown, for example, a timer, a counter, an input interface, an output interface and the like.

In the ROM 53 and the RAM 54, the following data are stored: a processing program for executing the stapling and the punch processing, parameters that relate passage of a sheet through the sheet detection sensor 31 to a timing when a sheet is discharged from the bundle discharge rollers 6, parameters that relate to detection results from the sheet detection sensor 31 and to timings and the like when the hold portions 34*a* to 34*c* rotate to the release position, parameters that relate to detection results from the sheet detection sensor 31 and to timings and the like when the main tray moves to the wait position H2 and the hold position H1, parameters that relate to detection results from the sheet detection sensor 31 and to timings and the like when the hold portions 34*a* to 34*c* rotate to the lowest position and the release position, parameters that relate a detection result from the hold position detection sensor 41 to rising-stop operation of the main tray 11, and other data.

The control portion 51 reads parameters stored in the storage portion 52 and carries out an overall control following a predetermined program over the punch unit PU, the tip-end binding unit SU, the center binding and folding unit CU, the pair of feed-in rollers 3, the bundle discharge rollers 6, the upward and downward moving operation of the main tray 11 and other operations. In addition, the control portion 51 has a function to receive a detection result from the sheet detection sensor 31 and makes the hold solenoid 36 enabled and disenabled to rotate the hold portions 34*a* to 34*c* at a predetermined timing, and a function to make the tray lift device 25 operate to move the main tray 11 up and down.

Figure 7A:
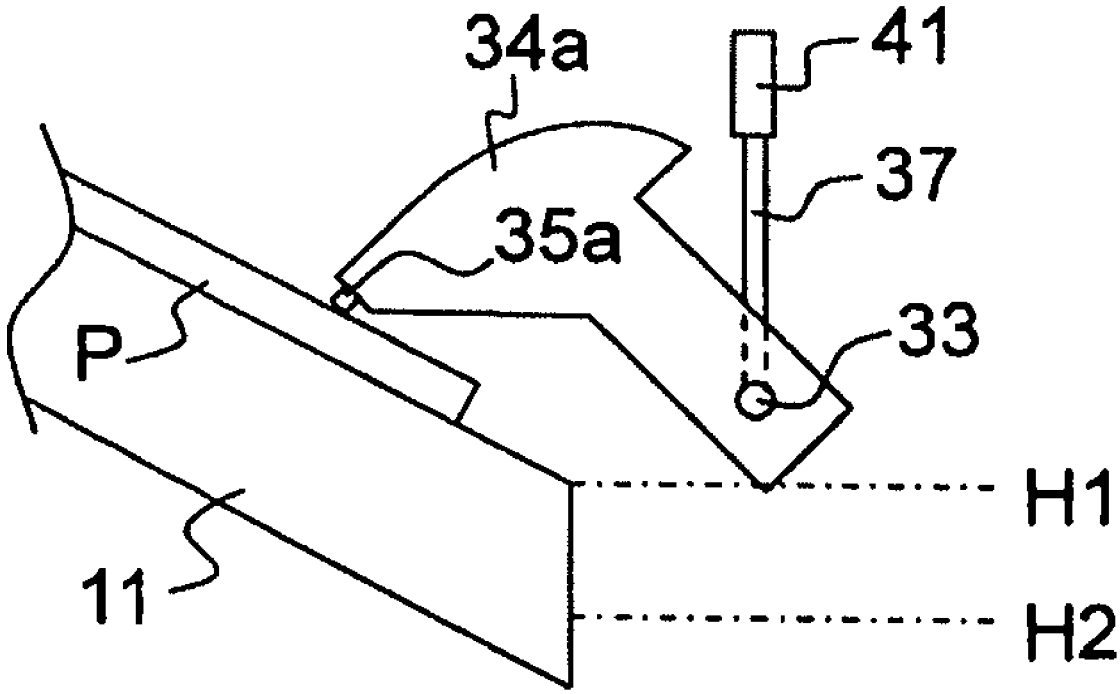
FIG. 7A is a view showing operation of a sheet post-processing apparatus according to the embodiment of the present invention, that is, a partial side view showing a state in which a hold portion holds a sheet bundle.
Figure 7B:
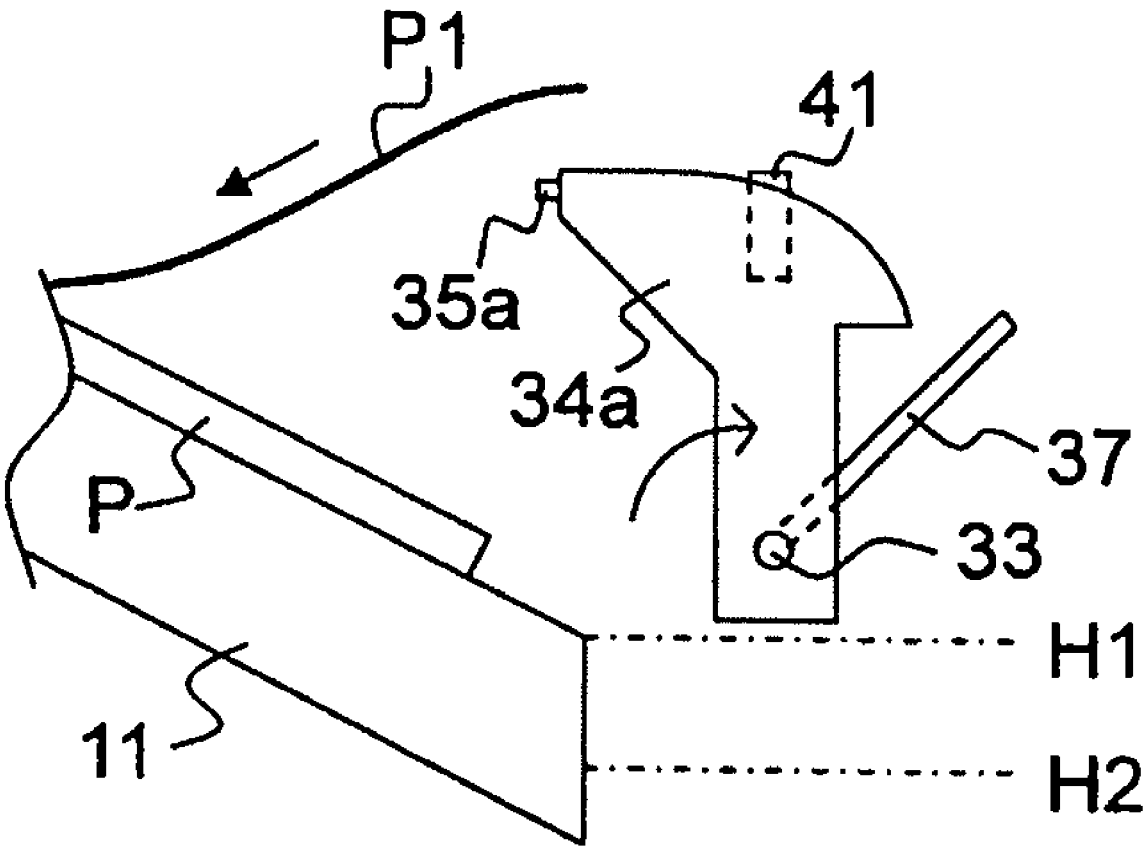
FIG. 7B is a view showing operation of a sheet post-processing apparatus according to the embodiment of the present invention, that is, a partial side view showing a state in which a hold portion rotates to a release position.
Figure 7C:
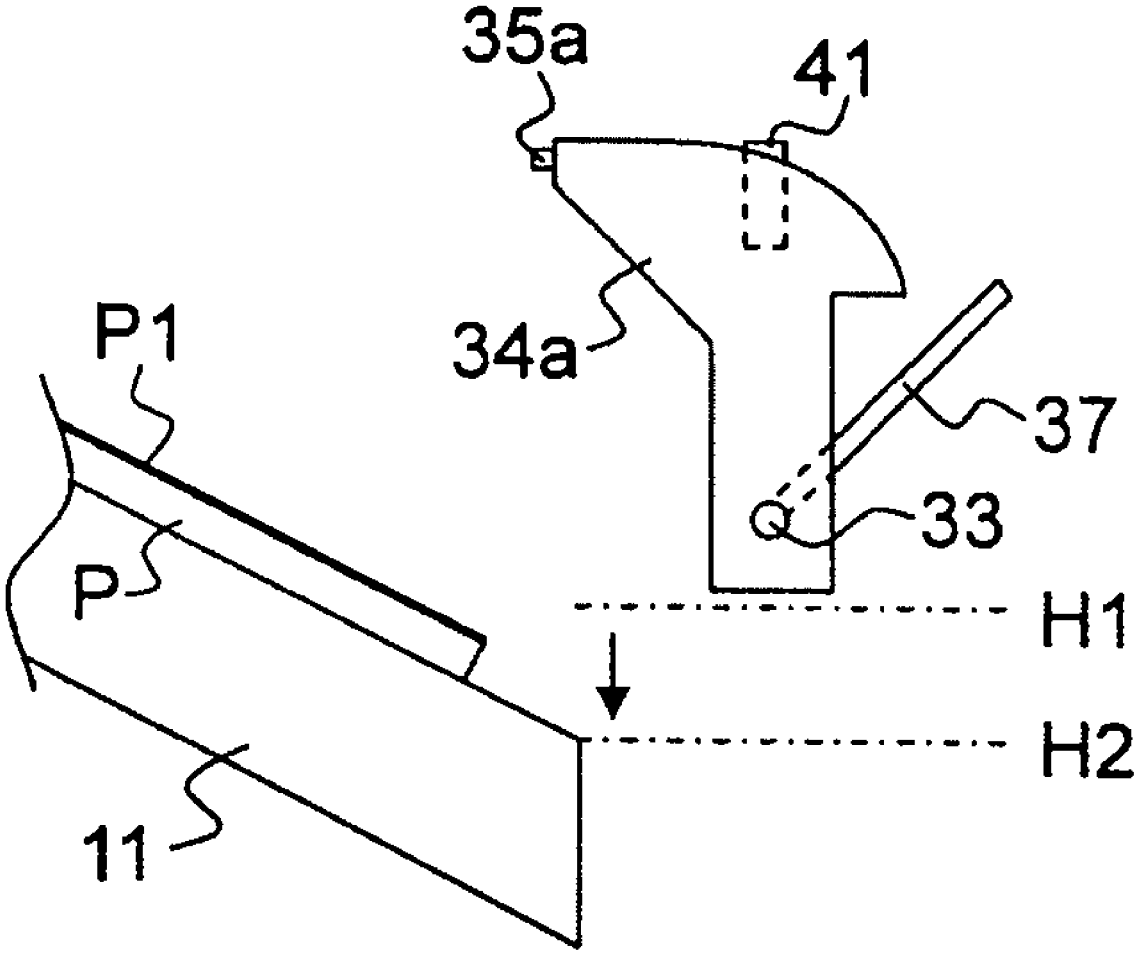
FIG. 7C is a view showing operation of a sheet post-processing apparatus according to the embodiment of the present invention, that is, a partial side view showing a state in which a main tray moves to a wait position.
Figure 7D:
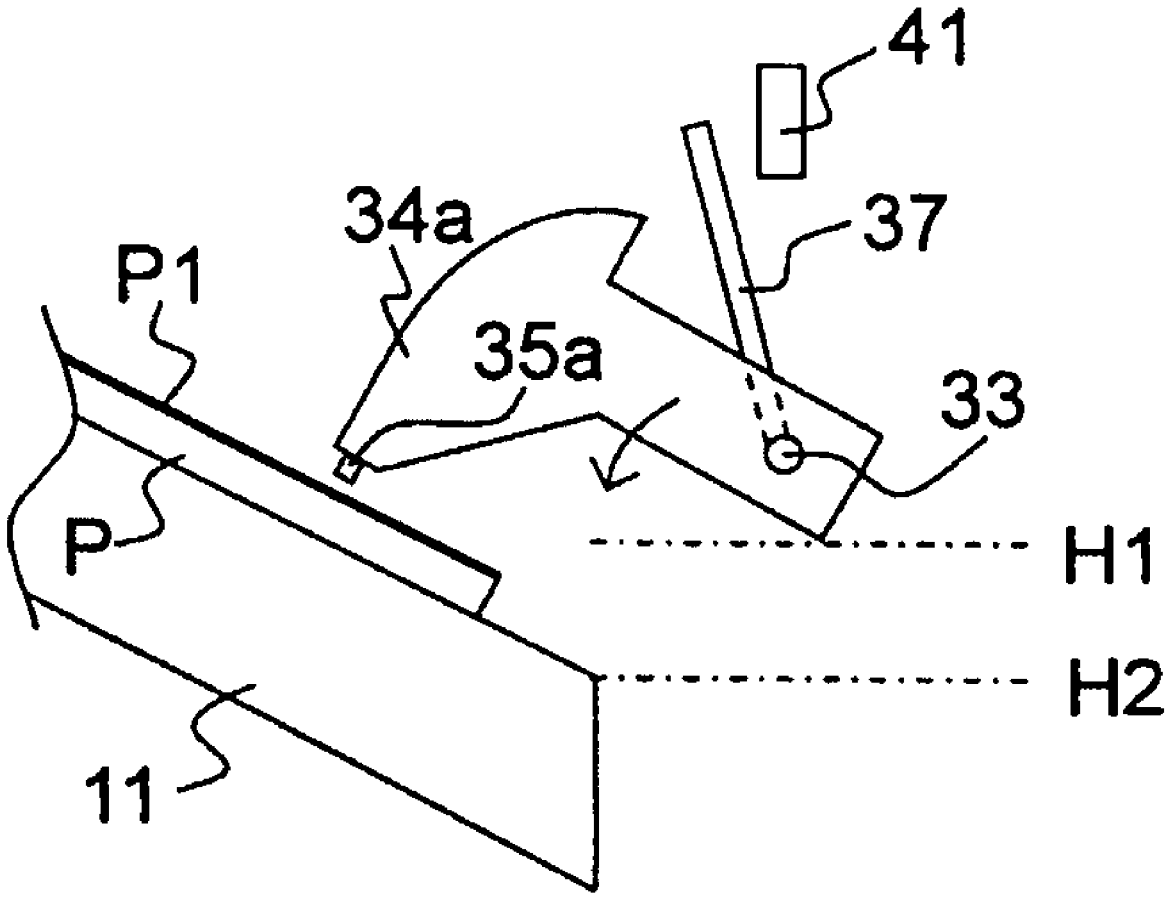
FIG. 7D is a view showing operation of a sheet post-processing apparatus according to the embodiment of the present invention, that is, a partial side view showing a state in which a hold portion rotates to the lowest position.
Figure 7E:
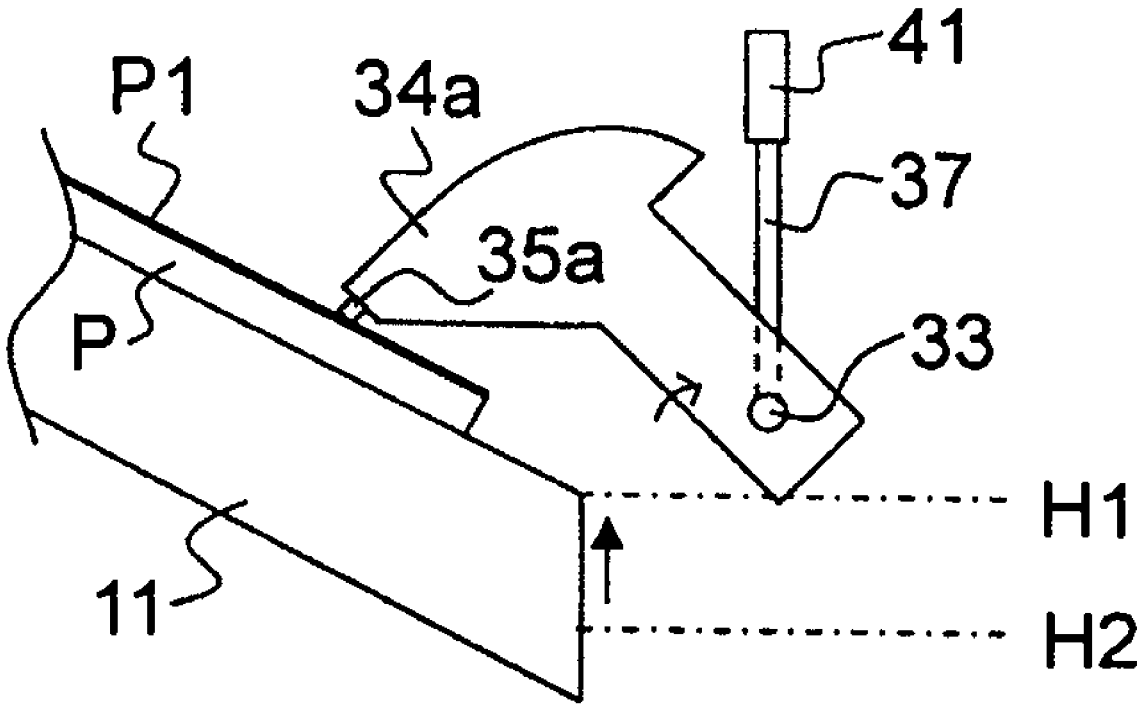
FIG. 7E is a view showing operation of a sheet post-processing apparatus according to the embodiment of the present invention, that is, a partial side view showing a state in which a main tray moves up to a hold position.
Figure 8:
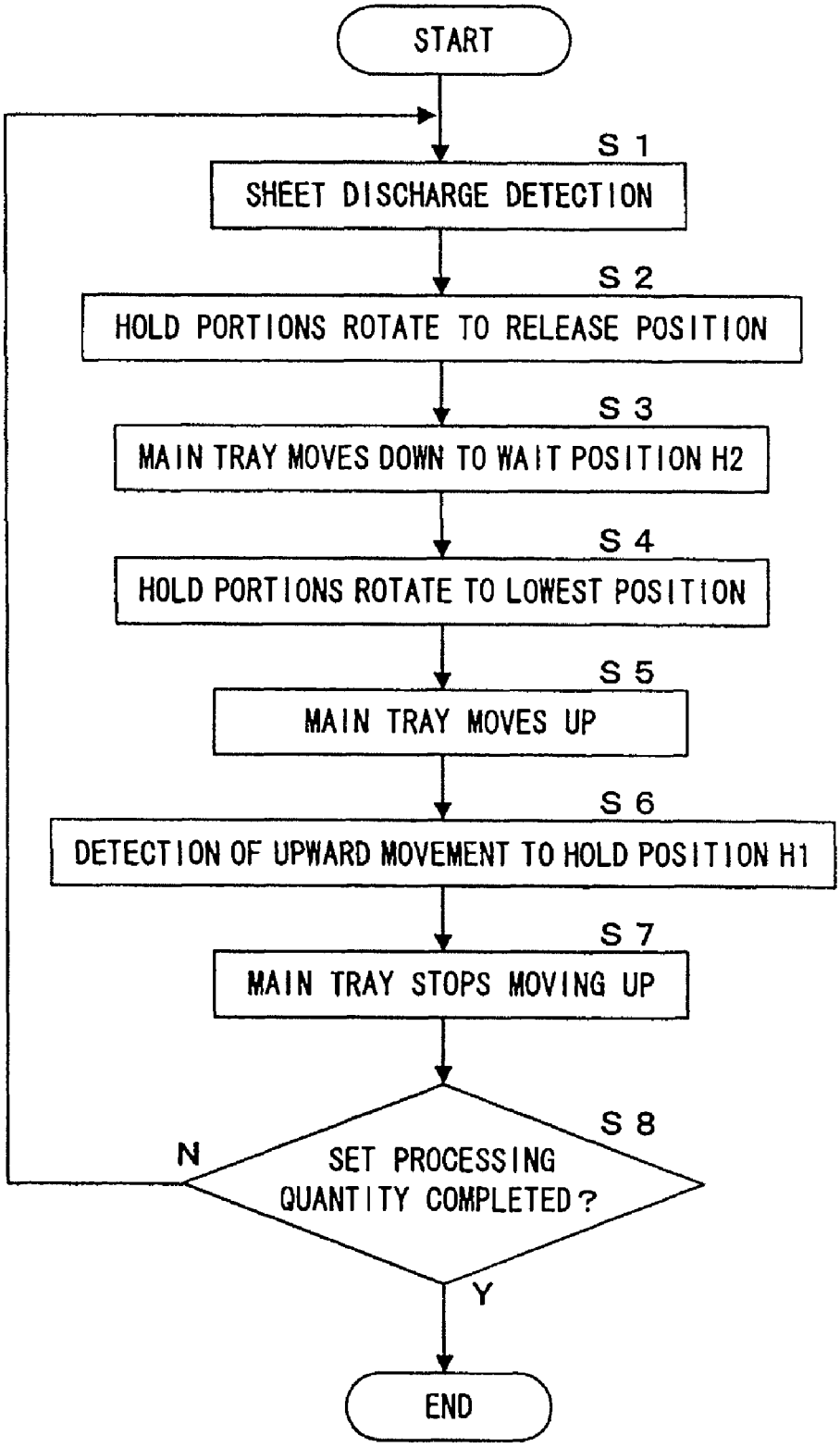
FIG. 8 is a flow chart showing operation of a sheet post-processing apparatus according to the embodiment of the present invention.

Next, operation of the sheet post-processing apparatus 100 is explained. FIG. 7 is a view showing operation of the sheet post-processing apparatus according to the embodiment of the present invention, in which FIG. 7A is a partial side view showing a state in which the hold portion holds a sheet bundle, FIG. 7B is a partial side view showing a state in which the hold portion rotates to the release position, FIG. 7C is a partial side view showing a state in which the main tray moves to the wait position, FIG. 7D is a partial side view showing a state in which the hold portion rotates to the lowest position, and FIG. 7E is a partial side view showing a state in which the main tray moves up to the hold position. In FIGS. 7A to 7E, the positions H1 and H2 indicate the positions of the discharge tray in the state where no sheets are stacked on the main tray 11. FIG. 8 is a flow chart showing operation of the sheet post-processing apparatus. Parts common to FIGS. 1 to 6 are indicated by common numbers and explanation of them is skipped.

Here, as an example, stapling is explained. As described above, when stapling is selected, a quantity (processing quantity) of sheets to be processed is set, and a sheet on which an image is printed is carried to the sheet post-processing apparatus (start), the carried sheet is stacked on the processing tray 1 (see FIG. 1) to be bound at the lower end, is moved again upward along the processing tray 1, and carried to the bundle discharge rollers 6.

As shown in FIG. 7A, first, the main tray 11 is moved to the hold position H1, and the hold portions 34*a* to 34*c* hold the backward end of the sheet bundle P in the discharge direction. In this state, when the tip end of the sheet bundle P1 that has undergone the stapling passes the sheet detection sensor 31 and is carried to the bundle discharge rollers 6, the bundle discharge rollers 6 discharge the sheet bundle P1 to the main tray 11.

When the backward end of the sheet bundle P1 passes the sheet detection sensor 31, and when it is detected by the sheet detection sensor 31 that the sheet bundle P1 is discharged (the step S1), the sheet detection sensor 31 transmits the detection result to the control portion 51, the hold solenoid 36 (see FIG. 5) is enabled by the control portion 51, and the hold portions 34*a* to 34*c* rotate upward to the release position as shown in FIG. 7B (the step S2). Thus, the sheet bundle P1 is stacked on the top surface of the sheet bundle P without being obstructed by the hold portions 34*a* to 34*c*.

Considering the duration from the time when the sheet bundle P1 passes the bundle discharge rollers 6 to the time when the sheet bundle P1 is stacked on the main tray 11, after a predetermined time T1 elapses from the detection by the sheet detection sensor 31, the driving motor is operated by the control portion 51, and as shown in FIG. 7C, the main tray 11 moves downward to the wait position H2 where the hold portions 34*a* to 34*c* do not hold the top surface of the sheet bundle P even when the hold portions 34*a* to 34*c* rotate to the lowest position (the step S3).

When the main tray 11 moves downward to the wait position H2, the top surface of the sheet bundle P on the main tray 11 is detected by the wait-position detection sensor (not shown) and the detection result is transmitted to the control portion 51, so that the driving motor is stopped by the control portion 51 and the main tray 11 stops moving downward. In addition, after a predetermined time T2 longer than the time T1 elapses, the operation of the hold solenoid 36 (see FIG. 5) is stopped by the control portion 51, and the hold portions 34*a* to 34*c* rotate to the second hold position as shown in FIG. 7D (the step S4).

Considering the time the hold portions 34*a* to 34*c* take to rotate to the lowest position (the second hold position), after a predetermined time T3 longer than the time T2 elapses, the driving motor is driven by the control portion 51, and the main tray 11 moves up from the wait position H2 (the step S5). When the top surface of the sheet bundle P1 butts the hold portions 34*a* to 34*c* from the lower side of the hold portions 34*a* to 34*c*, the main tray 11 moves up pushing up the hold portions 34*a* to 34*c*.

Then, as shown in FIG. 7E, the main tray 11 moves up and the top surface of the sheet bundle P1 reaches the hold position H1, and the flag 37 is detected by the position detection sensor 41 (the step S6). And, the detection result is transmitted to the control portion 51, so that the driving motor is stopped by the control portion 51 and the main tray 11 stops moving up (the step S7).

Here, the hold portions 34*a* to 34*c* hold the top surface of the sheet bundle P with the aid of elastic force of the spring member 38 (see FIG. 5). It is determined whether or not the operation is completed (the step S8). When the quantity (processed quantity) of the processed sheets reaches the set processing quantity, the operation is terminated, and when the processed quantity does not reach the set processing quantity, the manipulations in the steps S1 to S7 are repeated. After the operation is terminated, the hold portions 34*a* to 34*c* return to the release position (the original position). Here, for explanation convenience, the operation from the state in which the sheet bundle P is stacked on the main tray 11 (FIG. 7A) to the state in which the sheet bundle P1 is discharged is explained. However, the hold portions 34*a* to 34*c* are held at the release position until the first sheet bundle P1 is discharged.

As described above, when it is detected by the sheet detection sensor 31 that the sheet bundle P1 is discharged by the bundle discharge rollers 6, the hold portions 34*a* to 34*c* rotate to the lowest position and the main tray 11 moves down to the wait position H2, and after this downward movement, the main tray 11 moves up to the hold position H1.

Thus, because it is possible to continue to hold the sheet bundle P1 discharged on the main tray 11 while preventing the hold portions 34*a* to 34*c* from hitting the sheet bundle P stacked on the main tray 11 until the next sheet bundle is discharged, it is possible to prevent poor alignment of the discharged sheet bundle P and to prevent noise generation during the time of discharging the sheet bundle P1. In addition, because the sheet bundle P is not hit, it is possible to prevent the sheet bundle from being damaged.

Here, because the hold-position detection sensor 41 is disposed to detect that the top surface of the sheet bundle on the main tray 11 moves up to the hold position H1, it is possible to surely push up the top surface of the sheet bundle on the main tray 11 to the hold position H1 and to stop the main tray 11 at the hold position H1. Besides, because the hold-position detection sensor 41 detects the flag 37, it is possible to confirm that the hold portions 34*a* to 34*c* rotate to the hold position and hold the upper surface of the sheet bundle P discharged on the main tray 11.

Thus, it becomes possible to more surely hold the sheet bundle P and to prevent poor alignment of the sheet bundle P. In addition, it is possible to avoid addition of members for detecting the upward movement of the main tray 11 to the hold position H1, thereby it is possible to prevent the apparatus from becoming large and complicated, which achieves low cost. However, the hold-position detection sensor 41 needs only to detect the height of the main tray 11, and it is also possible to employ a structure in which the hold position detection sensor 41 is able to directly detect the upward and downward movement of the main tray 11.

Besides, it is also possible to employ a structure that does not use the hold position detection sensor 41. In addition, the position, the shape and the like of the flag 37 can be suitably designed for the apparatus structure and the like. It is also possible to suitably set the rotation range of the hold portions 34*a* to 34*c* according to the apparatus structure and the like when the hold portions 34*a* to 34*c* can hold the top surface of the sheet bundle P and stop the holding.

The present invention is not limited to the embodiment described above, and various modification can be made without departing from the spirit of the present invention. For example, in the embodiment described above, it is possible to quickly rotate the hold portions 34*a* to 34*c* by using the hold solenoid 36. However, when it is possible to rotate the hold portions 34*a* to 34*c* as described above, the structure of the sheet hold apparatus 32 is not limited to the embodiment described above. Besides, a cam or the like can be used instead of the hold solenoid 36. In addition, when it is possible for the sheet hold member to change its state from the hold state to the release state, the sheet hold member is not limited to the embodiment described above.

In the embodiment described above, the upward movement of the main tray 11 from the wait position H2 to the hold position H1 is started at a time after the predetermined time T3 elapses from the detection by the sheet detection sensor 31. However, it is possible to control the start timing of the moving up based on a detection result from the wait-position detection sensor (not shown) detecting the main tray 11. Besides, it is possible to control the upward and downward movements of the main tray 11 between the hold position H1 and the wait position H2 by using a pulse motor, or by detecting a movement distance of the main tray 11.

Here, the stapling is described. However, it is needless to say that the present invention is applicable to a sheet or a sheet bundle to which other processings such as sort processing, punch processing and the like are applied, and to a sheet or a sheet bundle to which none of these processings is applied.

LIST OF REFERENCE NUMERALS

[patent document 1] JP-A-2003-128339
[patent document 2] JP-A-2001-226025

What is claimed is:

1. A sheet post-processing apparatus, comprising:

a discharge member for discharging a sheet;

a discharge tray being movable up and down and for stacking sheets discharged from the discharge member successively thereon;

a sheet detector for detecting that the sheet is discharged from the discharge member; and a sheet hold member being capable of changing states between a hold state in which the sheet hold member holds a top surface of sheets discharged to the discharge tray and a release state in which the hold is released, wherein the discharge tray is capable of moving up and down between a hold position where the top surface of the sheets is held by the sheet hold member which is in the hold state and a wait position which is lower than the hold position and where the top surface of the sheets is not held by the sheet hold member which is in the hold state, with the discharge tray situated at the hold position and with the sheet hold member holding the sheet stacked on the discharge tray, discharge of the sheet onto the discharge tray is started, and when the sheet detector detects completion of the sheet discharge, the sheet hold member changes state from the hold state to the release state and the discharge tray moves down from the hold position to the wait position, then, the sheet hold member changes to the hold state and the discharge tray moves up to the hold position, and thereby the top surface of the sheets is held by the sheet hold member.

2. The sheet post-processing apparatus according to claim 1, further comprising a position detector for detecting that the discharge tray moves up and reaches the hold position, and the upward movement of the discharge tray is stopped based on a detection result of the position detector.

3. The sheet post-processing apparatus according to claim 2, wherein the position detector detects states of the sheet hold member.

4. The sheet post-processing apparatus according to claim 1, wherein the hold position of the discharge tray includes a first hold position at which sheets are able to be stacked successively and a second hold position which is positioned between the first hold position and the wait position, the sheet hold member is capable of changing states between a first hold state in which the sheet hold member holds the top surface of the sheets at the first hold position and a second hold state in which the sheet hold member holds the top surface of the sheets at the second hold position, and when the discharge tray moves up from the wait position to the first hold position, the discharge tray pushes up the sheet hold member from a lower side of the sheet hold member being in the second hold state, thereby the sheet hold member changes states from the second hold state to the first hold state.

5. The sheet post-processing apparatus according to claim 1, wherein the sheet hold member includes a rotation shaft that is rotatably supported, a hold portion protruding from the rotation shaft, and an attraction solenoid that has a plunger connected to the rotation shaft, wherein together with the rotation shaft, the hold portion changes states from the hold state to the release state when the solenoid is enabled, and changes states from the release state to the hold state when the solenoid is disenabled.

6. The sheet post-processing apparatus according to claim 5, wherein a plurality of the hold portions are arranged at predetermined intervals on the rotation shaft that is disposed along a sheet-width direction.

7. The sheet post-processing apparatus according to claim 5, wherein the rotation shaft and the plunger are connected to each other via a spring member.

* * * * *